US007048108B1

(12) United States Patent
Yellop et al.

(10) Patent No.: US 7,048,108 B1
(45) Date of Patent: May 23, 2006

(54) CURRENCY VALIDATION APPARATUS AND METHOD

(75) Inventors: Andrew Michael Yellop, Sandhurst (GB); Frank Mars, McLean, VA (US)

(73) Assignee: Mars, Incorporated, McLean, VA (US)

( * ) Notice: Subject to any disclaimer, the term of this patent is extended or adjusted under 35 U.S.C. 154(b) by 852 days.

(21) Appl. No.: 09/200,509

(22) Filed: Nov. 25, 1998

(30) Foreign Application Priority Data

Nov. 28, 1997 (GB) ..... 9725393.4

(51) Int. Cl.
*G07D 5/08* (2006.01)

(52) U.S. Cl. ..... 194/317; 194/318; 194/319

(58) Field of Classification Search ..... 194/317, 194/318, 319

See application file for complete search history.

(56) References Cited

U.S. PATENT DOCUMENTS

| | | | | |
|---|---|---|---|---|
| 4,936,435 | A * | 6/1990 | Griner | 194/317 |
| 5,355,989 | A * | 10/1994 | Best | 194/317 |
| 5,462,149 | A * | 10/1995 | Waine et al. | 194/317 X |
| 5,564,548 | A * | 10/1996 | Dobbins et al. | 194/317 |

FOREIGN PATENT DOCUMENTS

| | | |
|---|---|---|
| EP | 0 480 736 A2 | 4/1992 |
| GB | 1 452 740 | 10/1976 |
| GB | 2 279 796 A | 1/1995 |
| GB | 2 300 746 A | 11/1996 |

* cited by examiner

*Primary Examiner*—James McClellan
(74) *Attorney, Agent, or Firm*—Fish & Richardson P.C.

(57) ABSTRACT

A currency validator operates by comparing measured properties of inserted articles with acceptance criteria. A set of acceptance criteria can be either enabled or disabled automatically. Some sets of acceptance criteria can be considered after an acceptance/rejection decision, and if they are met they are automatically enabled during a subsequent validation operation.

16 Claims, 6 Drawing Sheets

Figure 1:
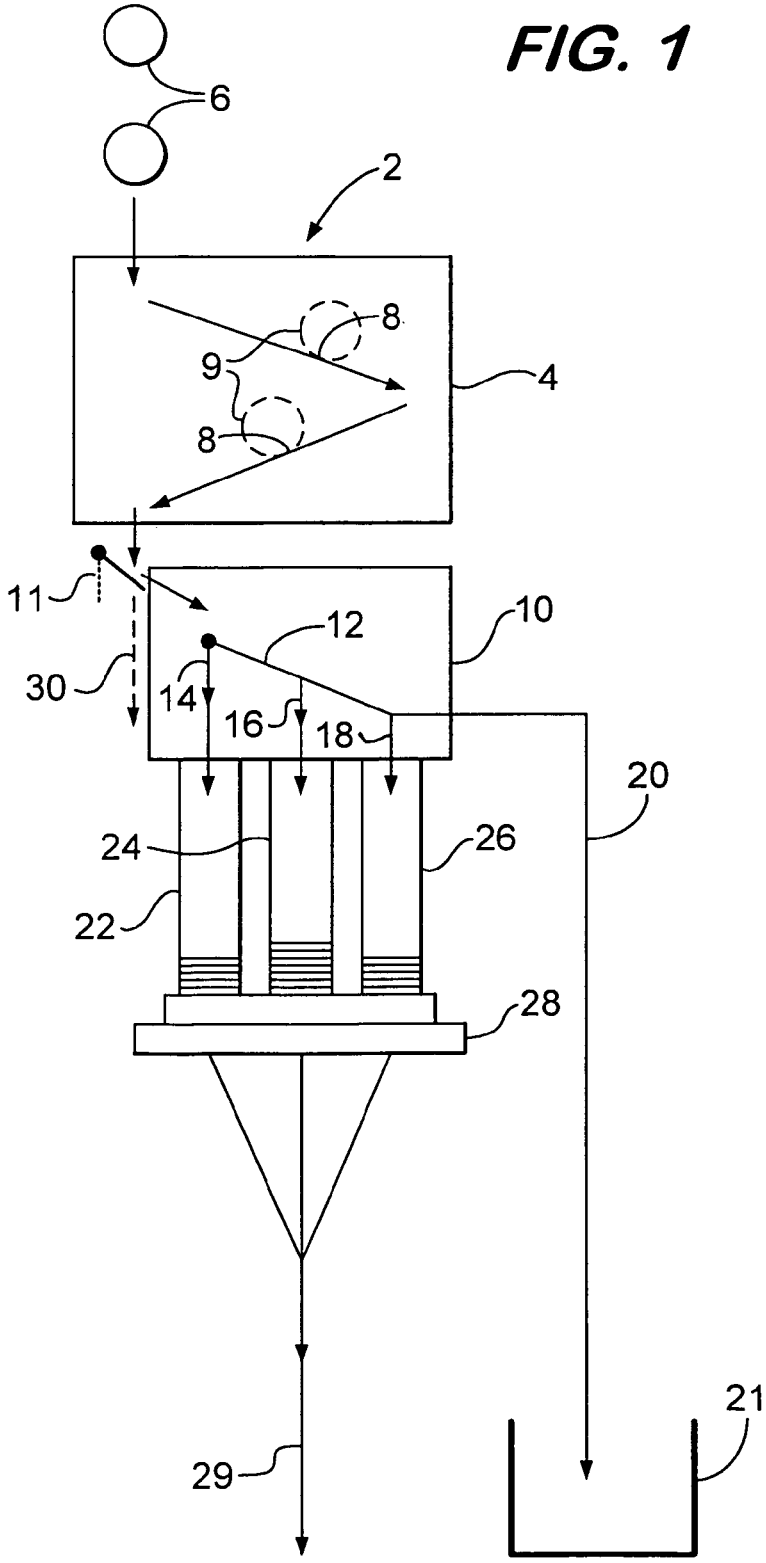

6
2
8
9
4
8
11
12
10
30
14
16
18
20
24
26
22
28
21
29

FIG. 2

| CT | 1U | 10U | 50U | 100U | 1E | 10E |
|---|---|---|---|---|---|---|
| UL1 | 129 | .... | .... | .... | .... | .... |
| LL1 | 121 | .... | .... | .... | .... | .... |
| UL1 | 243 | .... | .... | .... | .... | .... |
| LL2 | 210 | .... | .... | .... | .... | .... |
| UL3 | 27 | .... | .... | .... | .... | .... |
| LL3 | 24 | .... | .... | .... | .... | .... |

202

| CT | 2U | 5U | 20U | 5E | T1 | T2 |
|---|---|---|---|---|---|---|
| UL1 | 217 | .... | .... | .... | .... | .... |
| LL1 | 193 | .... | .... | .... | .... | .... |
| UL1 | 312 | .... | .... | .... | .... | .... |
| LL2 | 301 | .... | .... | .... | .... | .... |
| UL3 | 54 | .... | .... | .... | .... | .... |
| LL3 | 45 | .... | .... | .... | .... | .... |

204

FIG. 4

| A | US | CV | CR | UL1 | LL1 | UL2 | LL2 | UL3 | LL3 |
|---|---|---|---|---|---|---|---|---|---|
| R | 239 | 1 | U | 129 | 121 | 243 | 210 | 27 | 24 |
| R | 213 | 2 | U | .... | .... | .... | .... | .... | .... |
| L | 013 | 5 | U | .... | .... | .... | .... | .... | .... |
| R | 345 | 10 | U | .... | .... | .... | .... | .... | .... |
| R | 196 | 20 | U | .... | .... | .... | .... | .... | .... |
| R | 177 | 100 | U | .... | .... | .... | .... | .... | .... |
| L | 054 | 10 | E | .... | .... | .... | .... | .... | .... |
| L | 102 | 25 | E | .... | .... | .... | .... | .... | .... |
| R | 320 | 50 | E | .... | .... | .... | .... | .... | .... |
| R | 265 | 5 | T | .... | .... | .... | .... | .... | .... |
| L | 121 | 20 | T | .... | .... | .... | .... | .... | .... |

402

| I | US | CV | CR | UL1 | LL1 | UL2 | LL2 | UL3 | LL3 |
|---|---|---|---|---|---|---|---|---|---|
| 4 | 239 | 1 | U | 129 | 121 | 243 | 210 | 27 | 24 |
| 5 | 213 | 2 | U | .... | .... | .... | .... | .... | .... |
| 11 | 013 | 5 | U | .... | .... | .... | .... | .... | .... |
| 1 | 345 | 10 | U | .... | .... | .... | .... | .... | .... |
| 6 | 196 | 20 | U | .... | .... | .... | .... | .... | .... |
| 7 | 177 | 100 | U | .... | .... | .... | .... | .... | .... |
| 10 | 054 | 10 | E | .... | .... | .... | .... | .... | .... |
| 9 | 102 | 25 | E | .... | .... | .... | .... | .... | .... |
| 2 | 320 | 50 | E | .... | .... | .... | .... | .... | .... |
| 3 | 265 | 5 | T | .... | .... | .... | .... | .... | .... |
| 8 | 121 | 20 | T | .... | .... | .... | .... | .... | .... |

602

CURRENCY VALIDATION APPARATUS AND METHOD

This invention relates to an apparatus and method for validating currency. The invention will be described primarily in the context of validating coins, but it could also be applied in other areas, such as validating banknotes.

It is well known to take measurements of articles of currency, e.g. coins, and to apply acceptability tests to determine whether the article is valid and its denomination. The acceptability tests are normally based on stored acceptability data. One common technique (see, e.g. GB-A-1 452 740) involves storing "windows", i.e. upper and lower limits for each test. If each of the measurements of a coin falls within a respective set of upper and lower limits, then the coin is deemed to be acceptable. The acceptability data could instead represent a predetermined value such as a median, the measurements then being tested to determine whether they lie within predetermined ranges of that value. Alternatively, the acceptance data could be used to modify each measurement and the test would then involve comparing the modified result with a fixed value or window. Alternatively, the acceptance data could be a look-up table which is addressed by the measurements, and the output of which indicates whether the measurements are suitable for a particular denomination (see, e.g. EP-A-0 480 736, and U.S. Pat. No. 4,951,799). Instead of having separate acceptance criteria for each test, the measurements may be combined and the result compared with a stored acceptance criterion for each possible denomination (cf. GB-A-2 238 152 and GB-A-2 254 949). Alternatively, some of these techniques could be combined, e.g. by using the acceptability data as coefficients (derived, e.g. using a neural network technique) for combining the measurements, and possibly for performing a test on the result. A still further possibility would be for the acceptability data to be used to define the conditions under which a test is performed (e.g. as in U.S. Pat. No. 4,625,852).

Normally, the acceptance data are produced by a calibration operation and are characteristic of how the apparatus responds to the specific types of item to be validated. However, it is alternatively possible for the data to be independent of the properties of the item itself, and instead to be characteristic of just the validation apparatus (e.g. to represent how much the apparatus deviates in its measurements from a standard) so that this data in combination with further data representing the standard properties of an item are sufficient for validation.

Whichever technique is used, different sequences of operations are possible. For example, it is possible to process all the acceptance criteria relating to a particular denomination before considering the criteria for the next denomination, etc. Alternatively, the criteria relating to a particular property may be considered for all the denominations before considering the criteria for the next property. In the former case, if desired, it is possible to terminate the validity checking operation as soon as it is found that the measured properties meet all the acceptance criteria for a particular denomination. In the latter case, it is possible at each stage to disregard a particular denomination if, at an earlier stage, the criteria for that denomination have not been met.

However, it is necessary to ensure that all the validation operations required for every type of coin which the apparatus is designed to accept can be performed in the time available. On the other hand, there is a desire for high-speed compact coin validators, where there is very little time available between the measuring of the properties and the time at which a signal must be issued to indicate whether or not the coin is valid. This problem is exacerbated if there is a need for many sets of acceptance criteria, for example in multi-currency validators.

It has also been proposed (see GB-A-2 300 746) to have criteria associated with non-acceptable coins ("slugs"), so that an article can be rejected if it is found to lie within such a window, and, possibly, the acceptance criteria for one or more acceptable denominations are adjusted as a result of determining that such a slug has been received. The requirement for such rejection criteria also increases the amount of time required for the validation operation.

It would be desirable at least to mitigate this problem.

Modern currency validators are capable of being configured in many different ways. For example, it is often possible to change the currency set which they are designed to validate, and to change the combination of currencies which they are capable of dispensing. It is also possible to adjust acceptance criteria if particular problems arise with respect to forgeries. Appropriate reconfiguration of coin validators often requires information concerning the performance of the machine, and the manner in which it is being used. For example, a coin validator may be required to validate different distributions of coinage in different geographical areas. It would therefore be desirable to provide an improved technique for obtaining information concerning the operations which have been carried out by a coin validator.

According to one aspect of the present invention, a method of currency validation involves comparing measured properties of an article with criteria associated with respective article types in order to provide a signal indicating whether or not the article belongs to one of those types, the method further comprising subsequently comparing the measured properties with criteria relating to further types of articles. Using a technique of this aspect of the invention, it is possible to take into account criteria relating to many more articles than can be considered in the time available for the validation operation. If an article under test, e.g. a coin, is one of the types considered prior to issuing an accept/reject decision signal, then it will be accepted in the normal way. If not, the article will still be checked against other denominations, so that the type of article can still be determined even if there is insufficient time to do so prior to issuing the signal.

This has a number of potential uses. First, it has been found that whenever someone inserts a coin or banknote into a validator and finds that it is rejected, there is a very high likelihood that the person will insert the article at least one more time in the hope that it will be accepted. Accordingly, by determining the nature of the rejected article in the period after rejection, it is possible to re-configure the validation operation so that the criteria for that type of article will be considered, during the next validation operation, prior to the time at which the accept/reject signal is generated. This means that when the coin or banknote is re-inserted, it is likely to be accepted.

Alternative or additional techniques are possible. For example, the machine may be arranged to keep a record of the types of articles which have been tested, possibly together with an indication of whether or not they have been accepted. By using the techniques of this aspect of the invention, a substantially more comprehensive record can be kept. This information can be used for either automatically or manually re-configuring the validator, or simply for statistical analysis by the validator owner or manufacturer.

Instead of causing the acceptance criteria for only one denomination to be considered prior to issuing the accept/reject signal in the next validation operation, this can be done for a group of denominations. For example, there may be a multi-currency validator arranged so that no denominations, or only a few denominations, of a particular currency are considered prior to the issuing of the accept/reject signal. However, if there is post-rejection determination that an article belongs to that currency type, the validation operation may be re-configured so that a plurality of sets of criteria, relating to denominations of that currency, are considered during the next validation operation prior to the issuing of the accept/reject signal.

The validation operations may be altered in response to a single coin having been found, following the issuance of the accept/reject signal, to meet a set of accepted criteria. Instead, this alteration may be arranged to be performed in response to data derived from a plurality of determinations made during the course of validating a plurality of articles. This data could be derived using statistical techniques on information derived from these determinations.

The invention also has other aspects. In a further aspect, a method of validating articles of currency involves checking measured properties of the article-against criteria relating to a plurality of types of articles prior to issuing a signal indicating whether or not the article is of one of said types, the method further involving automatically preventing one of those sets of criteria from being considered during a subsequent validation operation and/or causing a further set of criteria associated with a different type of article to be considered during a subsequent validation operation.

Using this technique, it is possible to have the validator store more sets of acceptance criteria than can be handled in the time available prior to issuing the accept/reject signal, with appropriate ones of the sets of criteria being switched into or out of the group considered prior to the issuing of the signal, so as to optimise the performance of the validator in accordance with the desired use thereof. The automatic switching can be achieved in response to various types of parameters, including data indicative of one or more previously-validated coins.

For example, a multi-currency validator may be arranged to validate a subset of the denominations of each of a plurality of currencies. As soon as an article of one particular currency is received, validated and accepted, the validator may be arranged to disable acceptance criteria associated with coins of at least some other currencies, and to enable instead further coins of the currency which has been accepted. Thus, a multi-currency validator can be arranged to configure itself automatically for the currency with which it is to be used.

Further aspects of the invention are set out in the accompanying claims. It will be appreciated that there are particular advantages in combining certain aspects of the invention.

The invention also extends to a currency validator using the methods of the invention.

Figure 3:
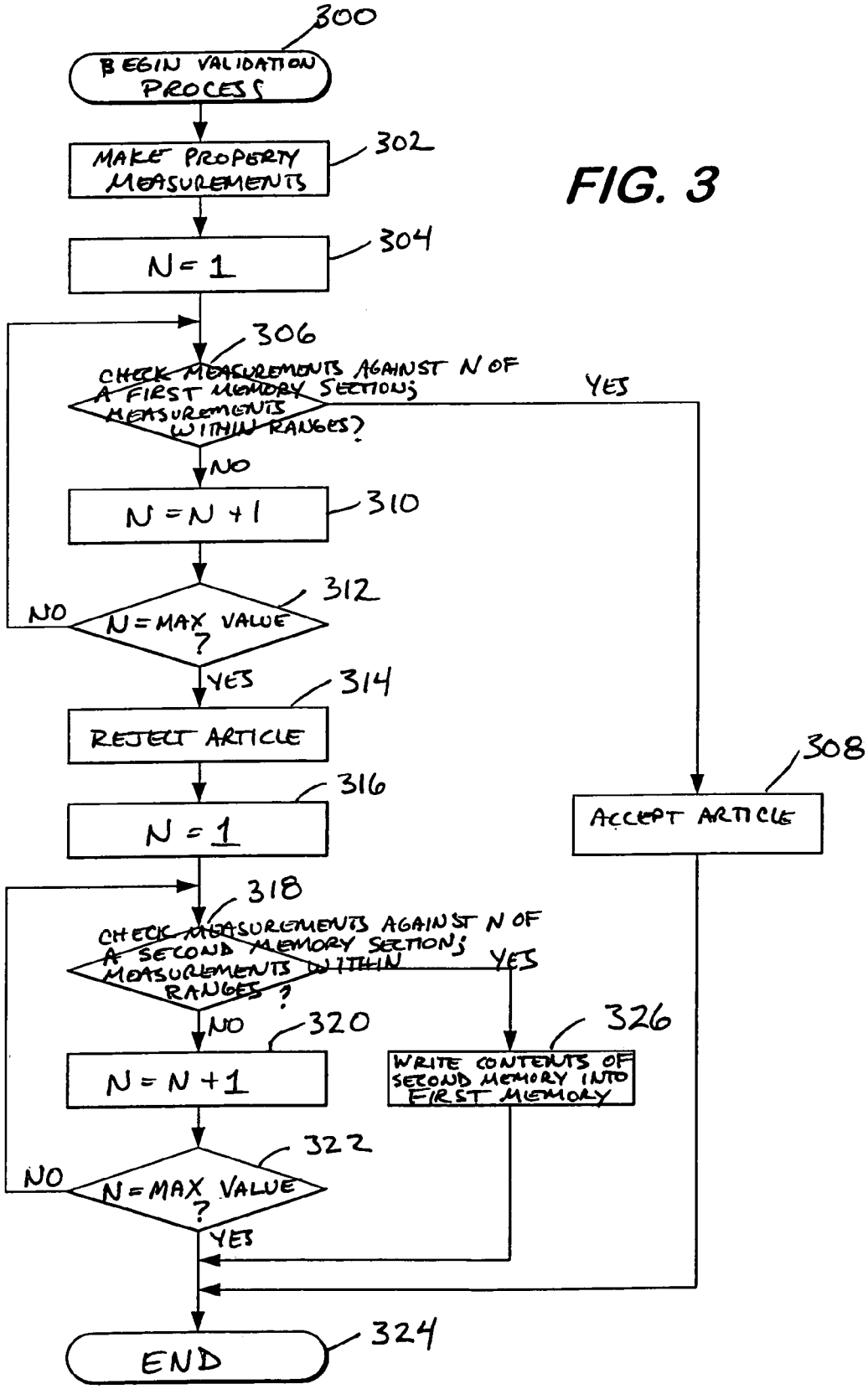
Figure 5:
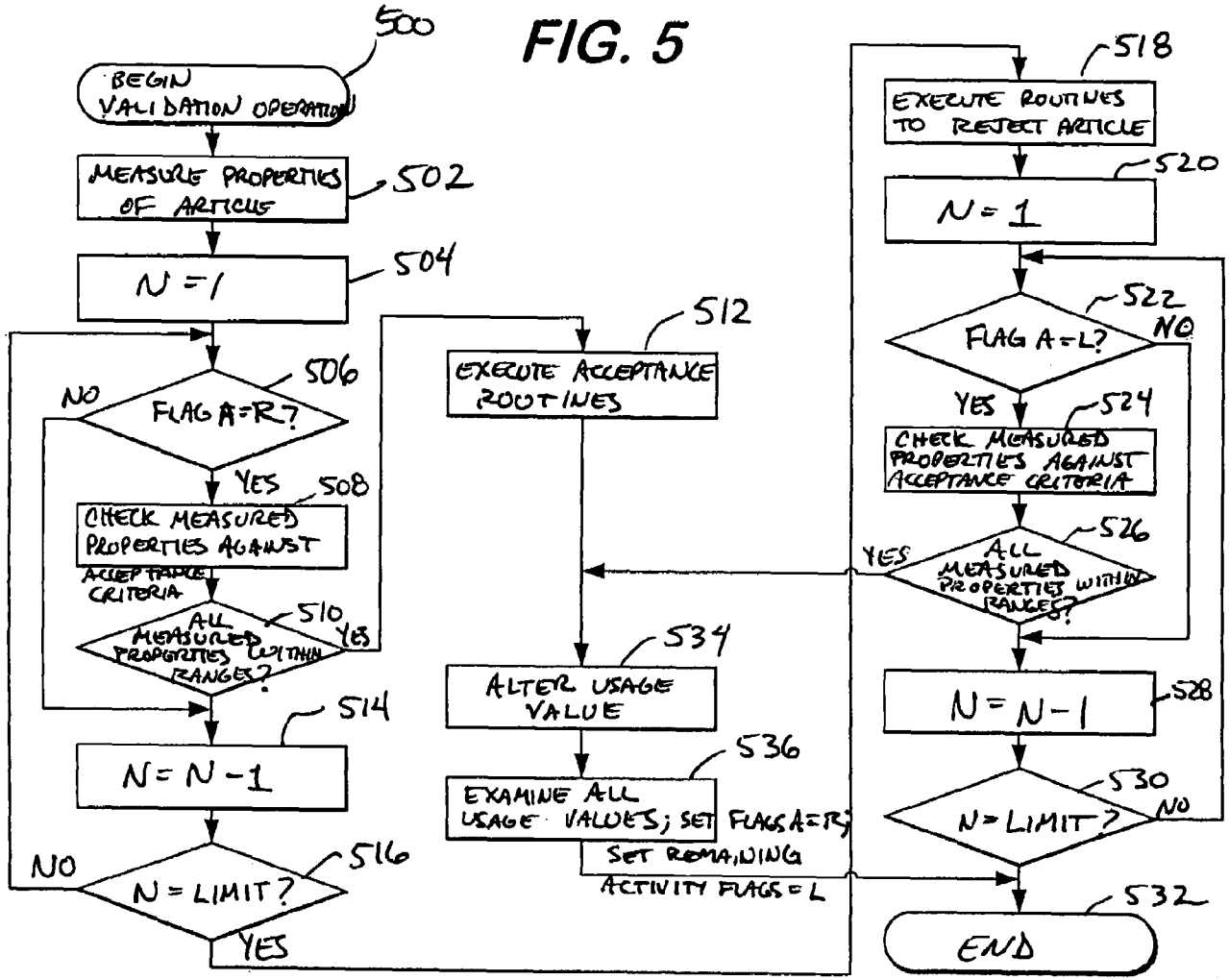
Figures 6, 8:
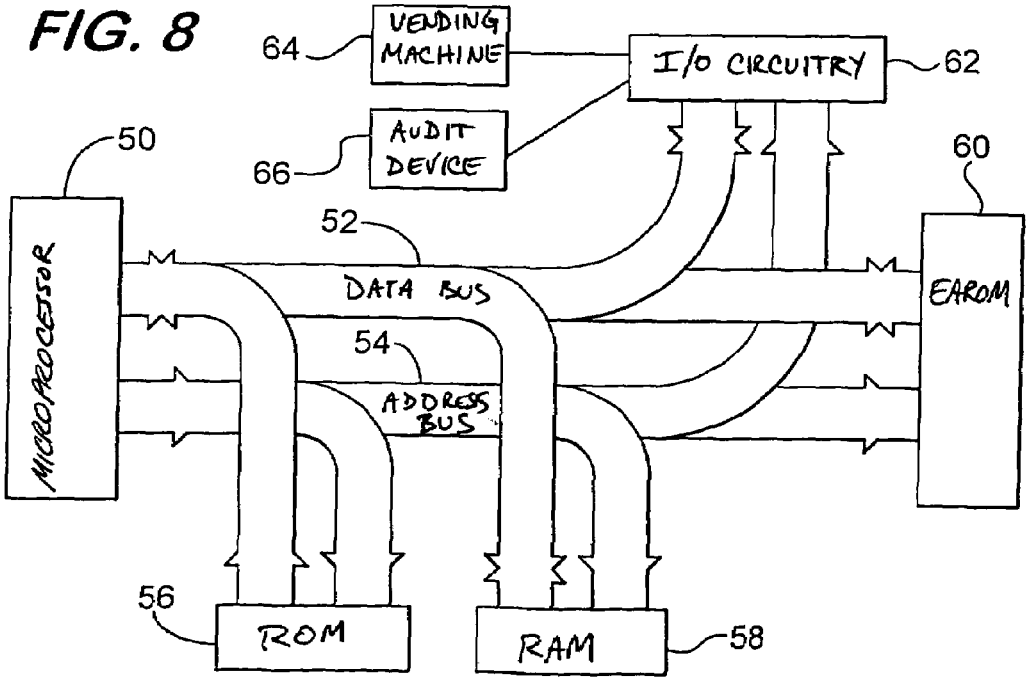
Figure 7:
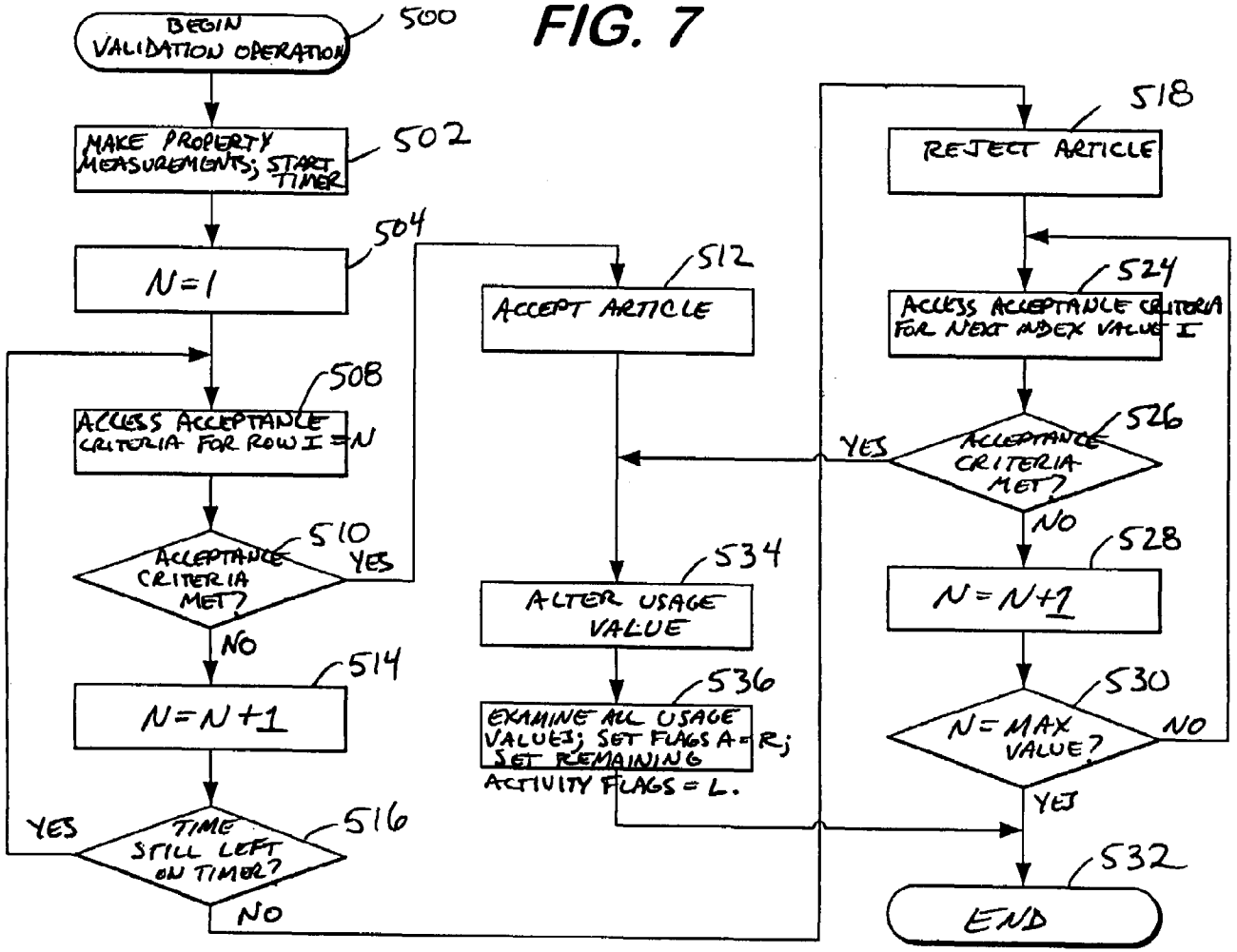

Arrangements embodying the invention will now be described by way of example with reference to the accompanying drawings, in which:

FIG. 1 is a block diagram of coin handling apparatus including a coin validator in accordance with the invention;

FIG. 2 schematically illustrates the contents of part of a memory of the validator;

FIG. 3 is a flowchart illustrating the operation of the embodiment;

FIG. 4 schematically illustrates the contents of a validator memory according to a modified embodiment of the invention;

FIG. 5 is a flowchart illustrating the operation of the modified embodiment;

FIGS. 6 and 7 correspond to FIGS. 4 and 5, but relate to a further modified embodiment; and FIG. 8 is a block diagram of the circuit of the coin handling apparatus.

Referring to FIG. 1, the coin handling apparatus 2 includes a coin validator 4 for receiving coins as indicated at 6. During the passage of the coins 6 along a path 8 in the validator 4, the coins are electromagnetically tested by a test station 9, following which the validator provides signals indicating whether the coins are acceptable, and if so the denomination of the coins.

Acceptable coins then enter a coin separator 10, as a result of the energisation of an accept/reject gate 11 in response to an accept signal from the validator 4. The separator 10 which has a number of gates (not shown) controlled by the circuitry of the apparatus for selectively diverting the coins from a main path 12 into any of a number of further paths 14, 16 and 18, or allowing the coins to proceed along the path 12 to a path 20 leading to a cashbox 21. If the coins are unacceptable, the gate 11 remains de-energised and instead of entering the separator 10 the coins are led straight to a reject slot via a path 30.

Each of the paths 14, 16 and 18 leads to a respective one of three coin tubes or containers 22, 24 and 26. Each of these containers is arranged to store a vertical stack of coins of a particular denomination. Although only three containers are shown, any number may be provided.

A dispenser indicated schematically at 28 is operable to dispense coins from the containers when change is to be given by the apparatus. The dispensed coins are delivered to a refund path 29.

Referring to FIG. 8 the circuit of the present embodiment of the invention incorporates a microprocessor 50 connected to data and address buses 52 and 54. Although separate buses are shown, data and address signals could instead by multiplexed on a single bus. A bus for control signals could also be provided.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the preferred embodiment, combined on a single integrated circuit.

The microprocessor 50 may also be connected via the buses 52 and 54 to an EAROM 60 for storing a variety of alterable parameters.

The microprocessor 50 is also coupled via the buses 52 and 54 to input/output circuitry indicated at 62. The circuitry 62 includes user-operable switches, at least one level sensor for each of the coin containers 22, 24 and 26, circuits for operating the dispenser 28, the accept/reject gate 11 and the gates of the coin separator 10, the circuitry of the coin validator 4, and a display visible to a user of the apparatus for displaying an accumulated credit value and an indication when insufficient coins are stored to guarantee that change will be available.

The input/output circuitry 62 also includes an interface between the control circuit of the apparatus and a vending machine 64 to which it is connected, and a further interface to an audit device 66.

In operation of the apparatus the microprocessor 50 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors of the coin containers 22, 24 and 26, and to control the gates in the separator 10 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change. The audit device 66 maintains a record of the number of coins of each denomination received and dispensed by the apparatus.

The arrangement so far is quite conventional, and the details of particular structures suitable for using as various parts of the mechanism will therefore not be described in detail.

The particular sequence of most of the operations carried out by the microprocessor may be the same as in previous apparatus. A suitable program to be stored in the ROM 56 can therefore be designed by anyone familiar with the art, and accordingly only the operations carried out by the particularly relevant parts of this program will be described.

Data defining coin acceptance criteria are stored by at least one of the memories 56, 58 and 60. Preferably, the data are stored in EAROM 60, but read into RAM 58 for processing purposes.

Referring to FIG. 2, the data defining the acceptance criteria are stored in two memory sections 202 and 204, which in this embodiment are located within the same address space and, preferably within the same physical memory circuit. Within each section, there are groups of storage locations each associated with a specific type of currency article. Within each group, there is an address location identifying the nature of the currency article, and further address locations containing acceptance criteria for that denomination.

In this embodiment, each group consists of seven memory locations. The first, within the rows labelled CT, contains a code indicative of the coin type (for example 1 U representing one UK penny, i.e. one unit in UK currency, 5 E representing five units of Euro currency, T1 representing a predetermined type of token, etc.).

Each group also comprises three pairs of memory locations, labelled UL1, LL1, UL2, LL2, UL3 and LL3. Each pair, e.g. UL1 and LL1, contains, respectively, upper and lower limits for a property range.

In performing the validation operation, using the apparatus of FIGS. 1 and 8, three property measurements are obtained. If all three measurements fall within the three respective ranges defined by a group of memory locations, then the received coin is deemed to be a valid coin of the type indicated by the contents of location CT within that group.

Referring to FIG. 3, the validation process begins at step 300, on detection that an article has been inserted. The three property measurements are made at step 302.

At step 304, a counter N is set to an initial value 1.

At step 306, the three property measurements are checked against the group identified by N, i.e. the first group, within memory section 202. If all three measurements lie within the respective ranges, the program proceeds to step 308, where the appropriate routines are executed to indicate acceptance of a valid coin of the type CT within group 1 of section 202.

Otherwise, the program proceeds to step 310, where the counter N is incremented. Then, at step 312, it is determined whether or not N has reached its predetermined maximum value. If not, the program loops back to step 306, wherein the property measurements are compared with the next group within section 202.

Accordingly, steps 306, 310 and 312 are repeated until either a valid coin of a type associated with section 202 is found, or until all the groups in that section have been checked.

Assuming that no valid coin has been found, the program proceeds to step 314, which contains the appropriate routines associated with rejecting the coin. (In practice, little action is necessary, because the accept/reject gate is simply kept in its normal position to allow the coin to go past into the reject channel.)

At step 316, the counter N is again initialised to the value 1.

Steps 318, 320 and 322 correspond to steps 306, 310 and 312, except that in this case the program checks the measured properties against the contents of the memory section 204. If a match is found, the program proceeds to step 326.

The memory contents 202 relate to all the denominations for which there is sufficient time to perform a checking operation prior to the time at which a decision must be made if the coin is to be accepted. The memory contents 204 represent additional coin types which can be checked following this time. If step 326 is reached, this means that one of the coins associated with memory section 204 has been inserted in the apparatus, but has been rejected. Accordingly, at step 326, the contents of the group of memory locations associated with the inserted coin are read out of memory section 204 and written into memory section 202. Therefore, if the same coin is re-inserted, a match will be found at step 306, and the coin will then be accepted at step 308.

There are a number of different ways in which the memory contents can be transferred from section 204 to 202. The following are two possible alternatives:

(a) There could be a spare group of memory locations in section 202. Each time step 326 is reached, the memory contents associated with the inserted coin are copied from section 204 and inserted into the spare locations within section 202.

(b) Each time step 326 is reached, the memory contents associated with the inserted coin, within section 204, may be exchanged for one of the groups of locations within section 202. For example, the contents of corresponding memory locations may be exchanged, so for example if step 326 is reached after N has been set to 3, then the third group of memory locations within each of sections 202 and 204 may be read out, and then written into the other of the memory sections.

A modified embodiment will now be described with reference to FIGS. 4 and 5. In FIG. 4, a section of a memory is schematically illustrated at 402. This section stores the acceptance criteria and other information associated with each of the currency articles which the validator is designed to accept. For each article of currency, 10 parameters are stored. These comprise:

(a) The acceptance criteria themselves, which in this case correspond to 6 upper and lower limits defining three ranges, as in the arrangement of FIG. 2, these being stored in the columns labelled UL1, LL1, UL2, LL2, UL3 and LL3.

(b) an indication of the value of the currency articles in predetermined units, stored in the column labelled CV. This corresponds to the amount by which a stored credit value is incremented on receipt of a valid coin of the respective type.

(c) a value, in the column labelled CR, denoting the currency to which the article belongs. In the illustrated embodiment, the articles belong to either UK currency ("U"), Euro currency ("E") or specially-manufactured tokens ("T").

(d) a usage indication, in the column labelled US, providing at least an approximate and relative indication of the number of times the associated currency units have been received by the validation apparatus; and (e) an active flag, in the column labelled A, which denotes whether the associated acceptance criteria are to be checked prior to, or following, a determination of validity of the received coin.

Referring to FIG. 5, the validation operation commences at step 500, on detection that an article has been inserted.

At step 502, the properties of the article are measured.

At step 504, a counter N is initialised to the value 1.

At step 506, the program accesses the flag A in the row of memory section 402 denoted by the counter N. The flag may be set either to "R" or "L". "R" represents run-time values which should be checked prior to a determination of validity. "L" represents library values which can be checked after the validity determination.

Accordingly, if the flag A is set to "R", the program proceeds to step 508 to check the measured properties against the respective acceptance criteria. A decision is made at step 510 dependent on whether all measured properties have been found to lie within the respective ranges. If so, the program proceeds to the usual acceptance routines at step 512.

Otherwise, the program proceeds to step 514, wherein N is incremented, and step 516, wherein N is checked to see whether it has reached a predetermined limit. If not, the program loops back to step 506.

If, at step 506, it is found that the flag A is set to "L", then the program proceeds straight to step 514, omitting the time-consuming steps 508 and 510.

This continues until either a valid coin has been found, in which case the program reaches step 512, or until N has reached its maximum limit, in which case all the acceptance criteria associated with the "R" values of the flag A would have been checked, and the program proceeds to step 518.

Step 518 is reached if the coin is to be rejected. Any necessary actions are performed at this step.

Then at step 520, counter N is set to 1 before continuing with steps 522, 524, 526, 528 and 530. These correspond respectively to steps 506, 508, 510, 514 and 516, except that at step 522 the program instead checks for the flag A having a value "L", and performs the acceptance criteria checking operations at steps 524 and 526 only if a value "L" is found. Thus, all the library ranges are checked. If the inserted article does not match any of the acceptance criteria, the program finishes at step 532.

If an inserted coin matches one set of acceptance criteria, then the program will eventually reach step 534 (either after the acceptance routines at step 512, if the acceptance criteria are associated with a run-time flag R, or after step 526 if the acceptance criteria are associated with a library flag L).

At step 534, the associated usage value US is altered as a result of the receipt of the valid coin. There are a number of different algorithms which can be used to achieve this. For example, the associated usage value can simply be incremented. To avoid overflows, all usage values can periodically be decremented by a certain value.

At step 536, the usage values US for all coins are examined. The m highest values are detected, and the associated flags A are all set to the value "R". The remaining activity flags are set to "L". The value m corresponds to the number of acceptance criteria which can be reliably checked before an accept/reject decision has to be made.

This embodiment has the advantage that the most commonly used currency articles will be checked in the period prior to making the accept/reject determination.

After step 536, the program routine ends at step 532.

The above embodiment may be modified by arranging for the flag updating operation at step 536 to be done relatively infrequently, e.g. after 100 validation operations, instead of after every validation operation. It should be understood, therefore, that references herein to changing the combination of acceptance criteria which are considered prior to the accept/reject decision "in response" to an article matching the acceptance criteria should be taken to include not only the possibility of this circumstance leading to an immediate and direct response, but also the possibility of this circumstance forming one of a number of factors which are collectively analysed to determine whether the response is ultimately produced.

A further modification of the embodiment will now be described with reference to FIGS. 6 and 7. This embodiment is similar to that of FIGS. 4 and 5, so only the differences will be discussed.

In FIG. 6, the memory contents are the same as those in FIG. 4 except that the activity flag A is omitted, and instead there is an index value I. At step 536, the usage values are checked and sorted in order of decreasing magnitude. This order is used to calculate the index values I, which are a continuous series of numbers starting with 1, representing the highest usage value, and then 2 representing the next highest, etc.

The operation illustrated by FIG. 7 is similar to that of FIG. 5 except as follows.

During step 502, when the property measurements are being made, the microprocessor starts a timer at the instant that the tested coin is in a known position with reference to the accept gate.

After step 504, wherein N is set to 1, the program proceeds to step 508. Here, the program accesses the acceptance criteria for the row wherein the index value I is equal to N. As before, step 510 checks to determine whether the acceptance criteria have met, and if not the program proceeds to step 514 to increment N.

At step 516, the program check the timer. The purpose of this is to determine whether or not it is necessary for the accept/reject decision to be made, i.e. to determine how close the coin is to the accept gate. If there is still some time left, the program loops back to step 508. Otherwise, the coin is rejected at step 518.

Instead of using a timer, a sensor (such as one of the validation sensors in the test station 9, or a dedicated sensor near the accept/reject gate 11) could be used to indicate that it is time to make the accept/reject decision.

In the case of rejection, the program proceeds from step 518 to step 524, to access the acceptance criteria for the next index value I. Step 526, as before, determines whether the acceptance criteria are met, and if not the program proceeds to step 528 to increment N.

At step 530, the program checks to determine whether N has reached the maximum possible value, which is determined by the number of different sets of acceptance criteria stored by the memory section 602.

Accordingly, the embodiment of FIGS. 6 and 7 is similar to that of FIGS. 4 and 5, except that the number of acceptance criteria which are checked prior to the accept/reject decision point may vary in accordance with the time available prior to this point. Thus, more criteria may be checked if the coin is moving slowly.

In principle, if a coin is found to match a set of acceptance criteria sufficiently quickly, then certain operations should be carried out, as in steps 308 and 512 of the previously-described embodiments. However, if the measured properties do not match a set of acceptance criteria, i.e. the coin is to be rejected, then it may not be necessary to take any action. This is particularly true if the apparatus is designed such that the accept/reject gate is, by default, in a position in which coins are led to the reject path. There would, nevertheless, be a point at which a reject decision has been made. This may not necessarily be signified by a discrete electrical signal. It may instead be signified by a combination of circumstances or states, some or all of which may be internal to the microprocessor. For example, a reject signal may be constituted by a combination of (a) a timer reaching a particular value, or some other signal indicating that the coin is so close to the accept gate that there is insufficient time to guarantee reliable routing to the accept path, and (b) the absence of a state which is set when a group of acceptance criteria have been met.

Various modifications to the above-described embodiments are possible.

For example, there could be further sets of acceptance criteria which are always considered prior to making the accept/reject decision. Thus, the switching of acceptance criteria between "run-time" and "library" sections can be performed only for currency articles which are less likely to be received.

The embodiments of FIGS. 4 to 7 may be modified such that, if a coin meets a set of acceptance criteria, the currency type CR for that coin is determined, and several sets of acceptance criteria associated with the same currency type, or all such acceptance criteria, are caused to be considered prior to the accept/reject decision point for future validation operations. Thus, the validator can be arranged automatically to recognise the currency of an inserted coin and in response thereto to make the validator effective for validating other articles of the same currency.

In principle, this principle can be extended to arrangements in which there are no acceptance criteria which are checked after the accept/reject decision point. Such an arrangement could be based on a conventional validator which stores additional sets of acceptance criteria which are not used during a particular validation operation. These would be associated with the same currency as a coin for which acceptance criteria are checked during the validation period. If such a coin is inserted, then the inactive acceptance criteria could be brought into operation in place of the currently active criteria.

Although the embodiments of the invention have been described in the context of changes in the combination of acceptance criteria which are considered prior of the accept/reject decision point, the invention has uses in other areas. Also, although the invention has been described in the context of acceptance criteria which define currency articles which the validator is designed to accept, it can also be applied to rejection criteria which define articles which the validator is designed not to accept.

By way of an example of a use of the invention in such other areas, there may be provided an otherwise-conventional validator which, in addition to storing the normal acceptance criteria, also stores rejection criteria at least some of which are not considered until after the accept/reject decision is made. If such rejection criteria are met, this signifies that a slug has been inserted, but not recognised as a valid coin. This can be used to adjust the acceptance criteria (e.g. in a manner similar to that described in GB-A-2 300 746), to reduce further the likelihood of that slug being subsequently accepted as a valid coin.

In addition to, or instead of, the various possibilities mentioned above, the validator may be arranged to store a record of articles which have been tested and found to match criteria which are considered either prior to or after the point at which an accept/reject decision is made. This information can be downloaded to an authorised data collection unit for statistical analysis by the owner or manufacturer of the validator, and may be particularly useful if the acceptance criteria relate to slugs.

In the arrangements described above, the processing of the measurements is performed serially. However, it is also possible to have a multi-tasking arrangement to perform several steps in parallel and thus reduce the processing time. Even in such arrangements, however, a finite time is required for processing, and the invention therefore still has significant benefits.

The invention has been described in the context of currency validators including coin validators, but it is to be noted that the term "coin" is employed to mean any coin (whether valid or counterfeit), token, slug, washer, or other metallic object or item, and especially any metallic object or item which could be utilised by an individual in an attempt to operate a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

The invention claimed is:

1. A method of validating articles of currency, comprising:

checking, prior to determining whether or not the article is to be accepted or rejected, the measured properties of an article against a plurality of sets of criteria, each set corresponding to a predetermined type of article;

determining whether the article is a valid type of one of the predetermined types and issuing a signal indicative of whether the article is to be accepted or rejected; and subsequently determining whether the measured properties meet at least one further set of criteria of an article of a different type, wherein the combination of sets which are checked prior to issuing the signal is altered.

2. A method as claimed in claim 1, wherein altering the combination is performed in response to determining that the measured properties meet a further one of the sets of criteria, and wherein the act of altering results in that further set of criteria being checked, in a subsequent validation operation, prior to issuing the signal.

3. A method as claimed in claim 2 wherein the act of altering results in that further set of criteria being checked in a next validation operation prior to issuing the signal.

4. A method as claimed in claim 1, wherein the act of altering includes altering the combination in a manner determined by which sets of criteria have been met in a plurality of previous validation operations.

5. A method as claimed in claim 1, wherein the act of altering includes causing a plurality of further sets of criteria, associated with a plurality of currency articles of a common currency, to be included within the sets which are checked prior to issuing the signal.

6. A method as claimed in claim 1, wherein the act of altering comprises causing one of the further sets of criteria to be considered prior to issuing the signal, and causing one of the first-mentioned sets criteria to be considered after the signal is issued.

7. A method as claimed in claim 6, wherein the act of altering is capable of causing any of the first-mentioned sets to be considered after issuing the signal.

8. A method of validating articles of currency, comprising:

checking, prior to determining whether or not the article is to be accepted or rejected, the measured properties of an article against a plurality of sets of criteria, each set corresponding to a predetermined type of article;

determining whether the article is a valid type of one of the predetermined types and issuing a signal indicative of whether the article is to be accepted or rejected;

subsequently determining whether the measured properties meet at least one further set of criteria of an article of a different type, and storing data indicating the number of articles which have met at least one further set of criteria in such a manner as to enable downloading of the data.

9. A method of validating articles of currency comprising:

measuring properties of an article;

checking the properties against a plurality of sets of criteria, each set corresponding to a predetermined type of article; and determining, as a result of the checking operation, whether the article is one of said types, wherein the criteria relating to respective types of articles are considered in a sequence, and the sequence is altered for a subsequent validation operation.

10. A method as claimed in claim 9, including issuing a signal indicating that the article is not genuine after a plurality of determinations and depending on the results of those determinations, and prior to further determinations being made.

11. A method of validating articles of currency comprising:

measuring properties of an article;

checking the properties against a plurality of sets of criteria, each set corresponding to a predetermined type of article, during a validation period prior to issuing a signal indicating whether the article is an article of one of the predetermined types; and automatically preventing a single one of the sets of criteria, associated with a predetermined type of article, from being considered during a validation period of a subsequent validation operation.

12. A method of validating articles of currency comprising:

measuring properties of an article;

checking the properties against a plurality of sets of criteria, each set corresponding to a predetermined type of article, during a validation period prior to issuing a signal indicating whether the article is an article of one of the predetermined types; and automatically causing a single different set of criteria, associated with a different type of article, to be considered during a validation period of a subsequent validation operation.

13. Apparatus for validating articles of currency comprising:

memory for storing data defining a plurality of sets of criteria, each set corresponding to a predetermined type of article; and a processor operable to compare measured properties of an article with the criteria, and further operable to permit the criteria to be rendered effective or ineffective and to increment a credit count if the article is of the predetermined type for which the criteria are effective, wherein the apparatus is capable of responding to recognition of a single article of one of the predetermined types by automatically preventing one of the sets of criteria from being effective during a subsequent validation operation, and then preventing incrementing of the credit count for the predetermined type of article.

14. Apparatus for validating articles of currency comprising:

memory for storing data defining a plurality of sets of criteria, each set corresponding to a predetermined type of article; and a processor operable to compare measured properties of an article with the criteria, and further operable to permit the criteria to be rendered effective or ineffective and to increment a credit count if the article is of the predetermined type for which the criteria are effective, wherein the apparatus is capable of responding to recognition of a single article of one of the predetermined types by automatically enabling a set of criteria, to be effective during a subsequent validation operation, thus enabling incrementing of the credit count when the predetermined type of article is recognized.

15. A method of validating articles of currency comprising:

measuring properties of an article;

checking the measured properties against a plurality of sets of criteria, each set corresponding to a predetermined type of article, during a validation period prior to issuing a signal indicating whether the article is an article of a said predetermined type, the number of sets checked being substantially equal to the maximum possible to be checked during said validation period; and wherein the method includes at least one of automatically preventing one of the sets from being considered during the validation period of a subsequent validation operation, and automatically causing a different set of criteria, associated with a different type of article, to be considered during the validation period of a subsequent validation operation.

16. A method of validating articles of currency comprising:

measuring properties of an article;

checking the measured properties against a plurality of sets of criteria, each set corresponding to a predetermined type of article and the predetermined types belonging to the same currency, during a validation period prior to issuing a signal indicating whether the article is an article of a said predetermined type; and wherein the method includes at least one of automatically preventing one but not all of said sets from being considered during the validation period of a subsequent validation operation, and automatically causing a different set of criteria, associated with a different type of article of the same currency, to be considered during the validation period of a subsequent validation operation.

* * * * *

UNITED STATES PATENT AND TRADEMARK OFFICE

CERTIFICATE OF CORRECTION

PATENT NO. : 7,048,108 B1
APPLICATION NO. : 09/200509
DATED : May 23, 2006
INVENTOR(S) : Andrew Michael Yellop and Frank Mars It is certified that error appears in the above-identified patent and that said Letters Patent is hereby corrected as shown below:

On the title page, item:
(56) References Cited - Foreign Patent Documents, include the following:
--UK 2 250 848 A June 17, 1992--.

Signed and Sealed this

Twenty-second Day of May, 2007

JON W. DUDAS
*Director of the United States Patent and Trademark Office*